US010801231B1

(12) United States Patent
Ensign

(10) Patent No.: US 10,801,231 B1
(45) Date of Patent: Oct. 13, 2020

(54) TENT WITH HEATER BASE

(71) Applicant: Cari A. Ensign, Perryvale (CA)

(72) Inventor: Cari A. Ensign, Perryvale (CA)

( * ) Notice: Subject to any disclaimer, the term of this patent is extended or adjusted under 35 U.S.C. 154(b) by 0 days.

(21) Appl. No.: 16/418,291

(22) Filed: May 21, 2019

Related U.S. Application Data

(60) Provisional application No. 62/674,140, filed on May 21, 2018.

(51) Int. Cl.
*E04H 15/12* (2006.01)
*E04H 15/20* (2006.01)
*E04H 15/10* (2006.01)

(52) U.S. Cl.
CPC ..... *E04H 15/12* (2013.01); *E04H 15/10* (2013.01); *E04H 15/20* (2013.01); *E04H 2015/201* (2013.01); *E04H 2015/206* (2013.01); *E04H 2015/208* (2013.01)

(58) Field of Classification Search
CPC ... E04H 15/12; E04H 15/20; E04H 2015/201; E04H 2015/208
See application file for complete search history.

(56) References Cited

U.S. PATENT DOCUMENTS 2,754,836 A * 7/1956 Darby ..... E04H 15/324 52/2.21
2,875,771 A * 3/1959 Brewin ..... E04H 15/20 52/2.11
3,457,684 A * 7/1969 Wood, Jr. ..... E04H 15/20 52/2.21
4,844,108 A 7/1989 Rohrer
4,896,655 A 1/1990 Urso
4,928,442 A * 5/1990 Kroetch ..... E04H 15/20 52/2.19
5,007,212 A * 4/1991 Fritts ..... E04H 15/20 52/2.18
5,247,768 A * 9/1993 Russo ..... E04H 15/20 52/2.13
5,479,743 A * 1/1996 Queen ..... E04H 15/20 52/2.22
5,487,400 A * 1/1996 Dawkins ..... E04H 15/20 135/124
5,502,927 A * 4/1996 Hammerton ..... E04H 15/20 135/116
5,630,296 A * 5/1997 Kendall, Jr. ..... A62B 31/00 52/2.11
5,913,322 A * 6/1999 Gallant ..... E04H 15/42 135/124
6,167,898 B1 * 1/2001 Larga ..... E04H 15/20 135/124
6,302,094 B1 10/2001 Wehrly et al.
6,491,051 B2 12/2002 Pierce et al.
(Continued)

FOREIGN PATENT DOCUMENTS

DE 29921241 U1 * 3/2000 ..... A47C 27/081
WO WO-2014080391 A1 * 5/2014 ..... E04H 15/20

*Primary Examiner* — David R Dunn
*Assistant Examiner* — Danielle Jackson
(74) *Attorney, Agent, or Firm* — Cramer Patent & Design, PLLC; Aaron R. Cramer

(57) ABSTRACT

A tent with a heater base includes a domed-shaped tent having a plurality of illuminated dome support rods and a heated base. The heated base has an inflatable air mattress having a length of heating tape running through the interior spaces thereof.

20 Claims, 4 Drawing Sheets

(56) References Cited

U.S. PATENT DOCUMENTS

| | | | | |
|---|---|---|---|---|
| 6,708,451 | B1 * | 3/2004 | Gomes | E04H 15/20 135/87 |
| 6,929,016 | B2 * | 8/2005 | Lee | E04H 15/20 135/126 |
| 8,011,986 | B1 * | 9/2011 | Curtsinger | B63B 2035/4426 441/35 |
| 8,776,812 | B1 * | 7/2014 | Forget | E04H 15/56 135/116 |
| 9,624,688 | B1 * | 4/2017 | Tyson | E04H 15/20 |
| 9,890,555 | B1 | 2/2018 | Woodall et al. | |
| 2009/0188539 | A1 | 7/2009 | Hollinger | |
| 2009/0300993 | A1 * | 12/2009 | Lamke | E04H 15/20 52/2.18 |
| 2011/0253184 | A1 * | 10/2011 | Mills | E04H 15/20 135/96 |
| 2012/0125390 | A1 * | 5/2012 | Damas | E04H 15/14 135/115 |
| 2012/0266929 | A1 | 10/2012 | Nelson et al. | |
| 2014/0190537 | A1 | 7/2014 | Benda et al. | |
| 2019/0010725 | A1 * | 1/2019 | Bueno | E04H 15/54 |

* cited by examiner

TENT WITH HEATER BASE

RELATED APPLICATIONS

The present invention claims the benefit of U.S. provisional application Ser. No. 62/674,140, filed May 21, 2018, the entire disclosures of which are incorporated herein by reference.

FIELD OF THE INVENTION

The present invention relates to tents. More specifically, it relates to tents having a heater base.

BACKGROUND OF THE INVENTION

Camping, hunting and other outdoor activities continue to be among today's most popular leisure activities. While different types of camping and different types of people will have different items in their camping equipment collection, just about all these collections will have a tent to provide basic protection from the elements.

However, tents are not without their disadvantages. First, they are difficult to set up, usually requiring two or more people. Second, they require a great deal of pieces and parts, and should any one of these parts become lost or broken, the integrity of the entire tent is in jeopardy. Third, the hard floor of the tent requires a separate air mattress or cot, to provide comfort and protection from the ground for sleepers. Finally, amenities such as heat and light are usually lacking. Accordingly, there is a need for a means by which tents can provide basic protection from the elements and personal comfort without the disadvantages as stated above. The use of the tent with heater base provides those who camp outdoors, the ability to have a tent which is not only easy and quick to setup and strike down, but comfortable as well.

SUMMARY OF THE INVENTION

The principles of the present invention provide for a tent, comprising first an inflatable frame covered by a tent cover. The tent cover includes a door flap which is removably affixed to the tent cover. The tent cover also has a plurality of sides. Second, a window provided on the tent cover. Third, an outer bottom perimeter of the tent cover extending partially up the sides of the tent cover. Fourth, a control access flap positioned on one side of the tent cover, the control access flap providing access to a plurality of mattress controls and a means for heating. Fifth, a mattress which has a plurality of upright supports in fluid communication with the mattress. The upright supports are intended to provide equal distribution of support for the tent cover. The mattress is an inflatable bladder and incorporates the means for heating therein. The means for heating is located within the mattress. The upright supports have a first end and a second end. Sixth, a port is disposed along one side of the mattress in mechanical and fluid communication with a means for delivering an inflating medium within the mattress and subsequently the upright supports. The port includes a cover to prevent the inflatable medium from exiting the mattress. Seventh, a rheostat dial being in selective electrical communication between an outside power source and the means for heating. The rheostat dial selectively powers the means for heating as well as control the desired temperature. Eighth, an electronics control housing which is located on the interior of the tent. Ninth, a power cord to allow for user control of a plurality of electrical components as used with the tent. Tenth, a mattress cover which is shaped to fully cover the mattress when fully inflated as well as covering a plurality of attachment points where the first ends of the upright supports engage with the mattress. Eleventh, a first fastener half which is located on an interior surface of the tent cover at a location superjacent to the upper surface of the mattress when fully inflated. Twelfth, a second fastener half which his located on a perimeter edge of one side of the mattress cover Thirteenth, a means for illuminating which is attached to the inflatable frame. Fourteenth, a control valve which allows for rapid deflation and allows suction to remove all air from the mattress and the upright supports for a minimum amount of storage space. Last, one or more USB power ports providing power for operating or charging personal electronics.

The door flap may be removably affixed to the tent cover by a zipper which may in turn be continuous to enable a portion of the door flap to remain attached to a remainder of the tent cover. The tent cover may be permanently or removably attachable to the inflatable frame and may have a generally rectangular shape made of waterproof fabric. The window may be removable and may be transparent.

The outer bottom perimeter of the tent cover includes a base made of material which is selected from the group consisting of waterproof material, resilient material, and puncture-resistant material. The mattress may generally be rectangular shaped when fully inflated and forms the bottom base of the tent. Each of the upright supports may have the first end attached to and extending away from an upper perimeter location on the mattress. The second ends of the upright supports may terminate in a common point, thereby ensuring that each of the upright support of the mattress is in fluid communication with each other to provide proper and even distribution of an inflatable medium.

The means for heating may be a continuous single electrically resistive heating coil or may comprise a plurality of the continuous single electrically resistive heating coils arranged in a plurality of zones. The means for delivering an inflating medium may be a compressor. The port may include a cap to prevent the inflatable medium from exiting the mattress. The rheostat dial may be located adjacent the port located on a panel and provided on the same side as the control access flap, such that access to the port and the rheostat dial is provided externally from the tent.

The electronics control housing may be located along an edge of the mattress such that it does not interfere with usage of the mattress but remains easy to access by hand while occupying the tent. The first fastener half and the second fastener half may be corresponding halves of a hook-and-loop-type fastener while the means for illuminating may comprise a plurality of light-emitting diodes lamps.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
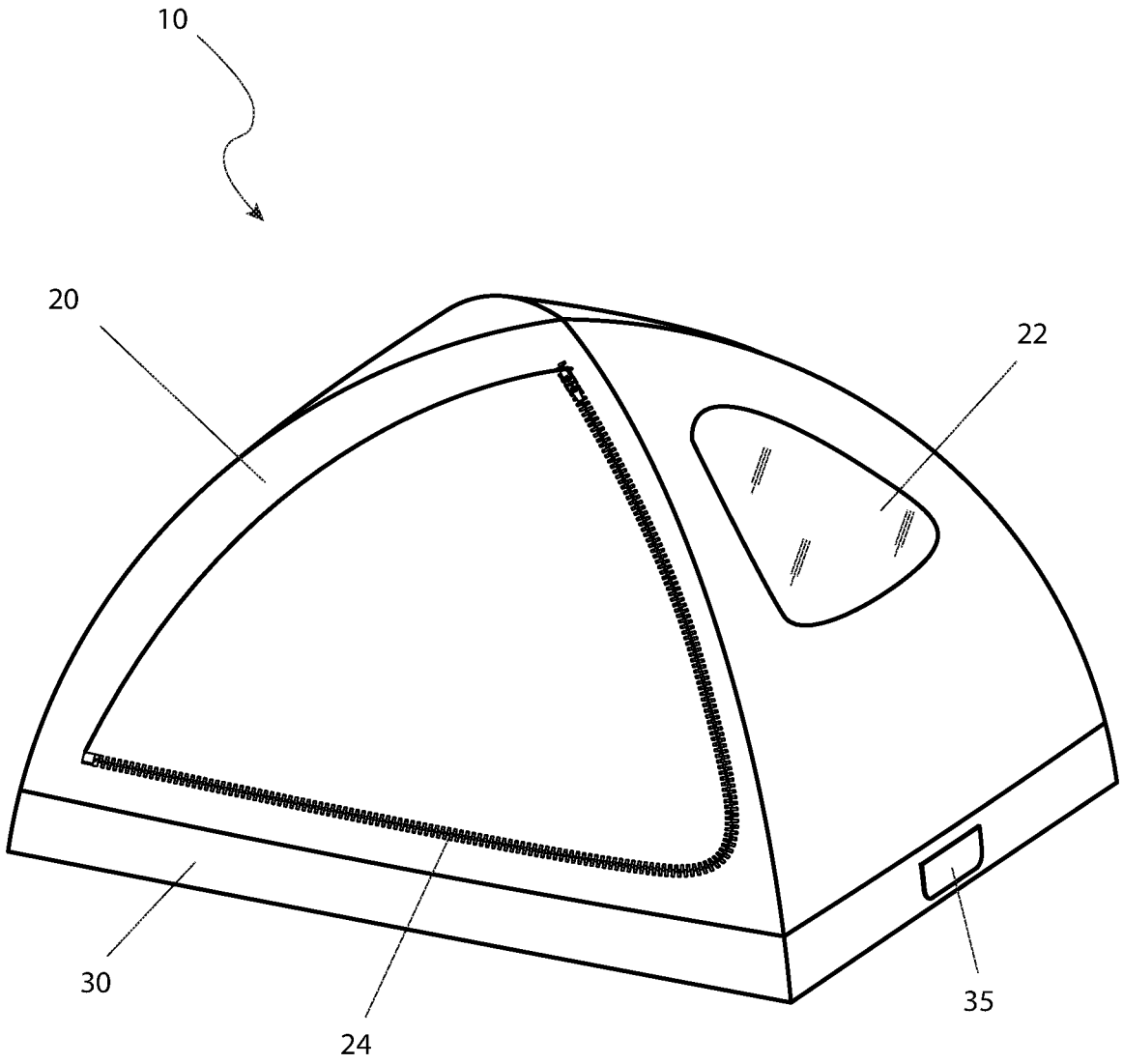
FIG. 1 is a front perspective view of the tent 10, according to a preferred embodiment of the present invention.

10 tent
11*a* first fastener half
11*b* second fastener half
12 mattress cover
13 lamp
15 cord
16 upright support
20 tent cover
22 window
24 zipper
25 mattress
26 heating means
30 waterproof base
35 control access flap
40 port
41 rheostat dial
50 control valve
55 electronics control housing
60 power cord
65 power supply
70 USB power ports
75 switch

1. Description of the Invention

Figure 2:
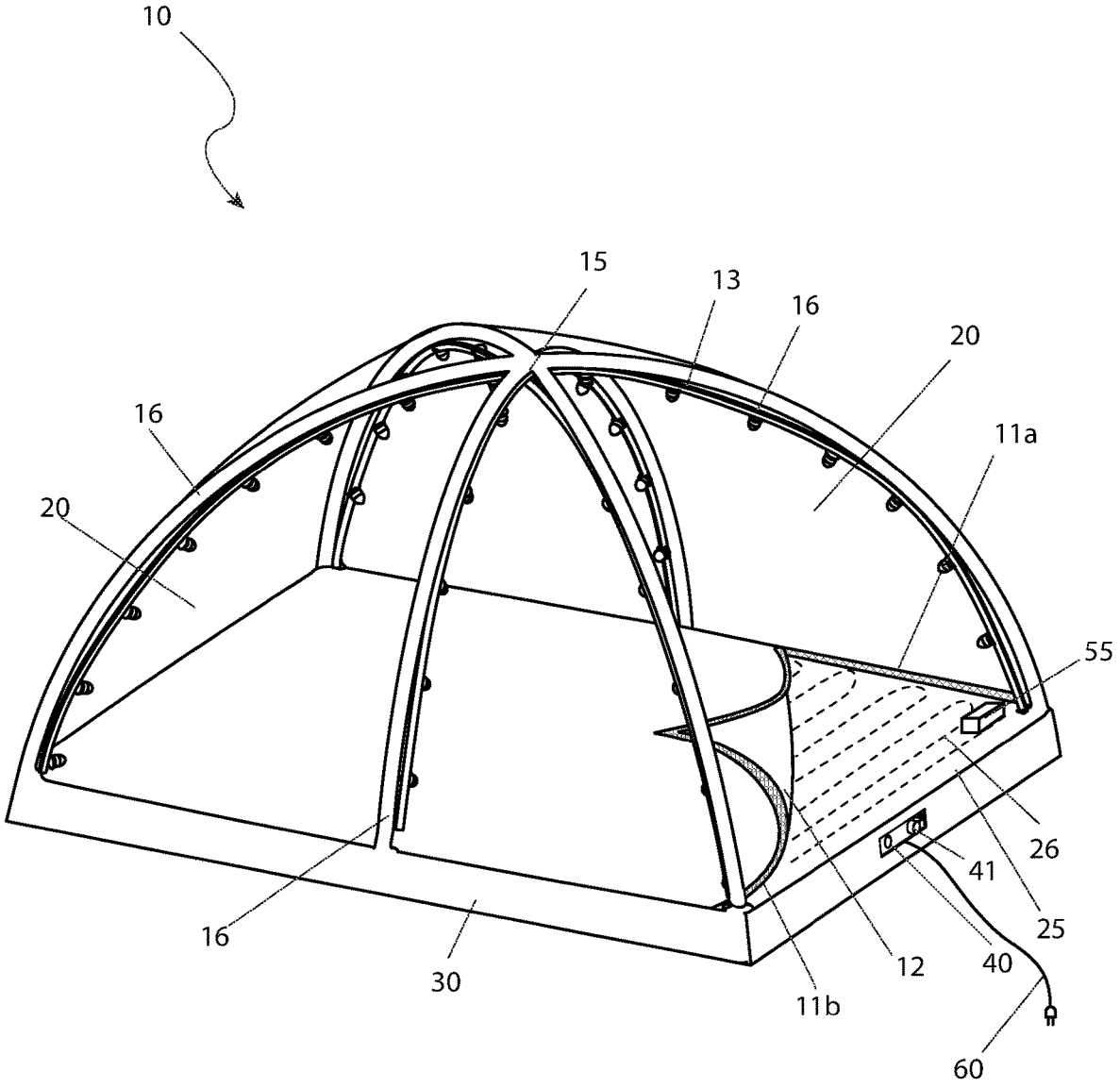
FIG. 2 is a front perspective, partially cut-away view of the tent 10, according to the preferred embodiment of the present invention.

The best mode for carrying out the invention is presented in terms of its preferred embodiment, herein depicted within FIGS. 1 and 2. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

2. Detailed Description of the Figures

FIG. 1 illustrates a perspective view of a tent 10. The tent 10 has an upright support 16, covered by a tent cover 20. The tent cover 20 is either removably attachable or permanently affixed to the upright support 16. The tent cover 20 is preferably a generally rectangular waterproof fabric having a door flap affixed to any or all portions thereof and removably by a zipper 24. The zipper 24 can be continuous or terminate to enable a portion of the door flap to remain attached to the remainder of the tent cover 20. Similarly, a window 22 is fashioned in any or all portions of the tent cover 20 and may be similarly provided as a flap like the door flap, or a removable or permanent transparent or translucent part of the tent cover 20. An outer bottom perimeter of the tent cover 20 and extending partially up the sides thereof, such as four inches (4 in.), is a waterproof base 30 fabricated out of a more waterproof, resilient, and puncture-resistant material. Further, a control access flap 35 is positioned on one (1) side of the tent cover 20, providing access to the controls of the mattress 25 and associated heating means 26.

Referring now to FIG. 2, showing a partial cut-away view of the tent 10 in generally the same orientation as in FIG. 1. In this view, the front portion and one (1) of the side portions of the tent cover 20 is removed so as to illustrate the interior of the tent 10, while the back portion and the opposing side portion of the tent cover 20 remains. The inflatable portion generally comprises a mattress 25 as a base and a plurality of upright supports 16 in fluid communication with the mattress 25. In a preferred embodiment, each upright support 16 has a first end attached to and extending away from an upper perimeter location on the mattress 25. Each second end of the upright supports 16 terminates in a common point or manifold, thereby ensuring that each upright support 16 and the mattress 25 is in fluid communication with each other, to provide proper and even distribution of an inflatable medium. The number and position of the upright supports 16 is intended to provide equal distribution of the support for the tent cover 20. Preferably, the second ends of the upright supports 16 and manifold (if provided) is located at the center point of the entire tent 10 and oriented in a dome-shaped, such that when the upright support 16 and the mattress 25 is fully inflated, the tent cover 20 is domed to enable debris, rain, and snow to not collect on the top.

The mattress 25 itself is generally rectangular when fully inflated and forms the bottom base of the tent 10. The mattress 25 is an inflatable bladder and incorporates a heating means 26 therein. The heating means 26 is located within the mattress 25 and can be a continuous single electrically resistive heating coil, or a plurality of such heating coils arranged in zones. Along one (1) side of the mattress 25 is a port 40 capable of being in mechanical and fluid communication with a compressor or other means of delivering the inflating medium within the mattress 25 and subsequently the upright supports 16. The port 40 may include a cover or cap to prevent the inflatable medium from exiting the mattress 25. Also located adjacent the port 40 is a rheostat dial 41 capable of being in selective electrical communication between an outside power source and the heating means 26. The rheostat dial 41 can selectively power the heating means 26, as well as control to the desired temperature. The port 40 and rheostat dial 41 are preferably located on a panel and provided on the same side as the control access flap 35 (see FIG. 1), such that access to the port 40 and rheostat dial 41 can be provided externally from the tent 10 itself. Also disclosed in FIG. 2 is an electronics control housing 55, located on the interior of the tent 10, and a power cord 60 to allow for user control of the electrical components as used with the tent 10. The location of the electronics control housing 55 is located along the edge of the mattress 25 such that it does not interfere with usage of said mattress 25 but remains easy to access by hand while occupying the tent 10. Further description of the electronics control housing 55 and a power cord 60 will be provided herein below.

A mattress cover 12 is also provided and is sized and shaped to fully cover the mattress 25 when fully inflated as well as covering the attachment points where the first ends of the upright supports 16 engage with the mattress 25. To accomplish this, a first fastener half 11*a* is located on an interior surface of the tent cover 20, at a location superjacent to the upper surface of the mattress 25 when fully inflated. A second fastener half 11*b* is located on a perimeter edge of one (1) side of the mattress cover 12. In a preferred embodiment, the first fastener half 11*a* and second fastener half 11*b* are corresponding halves of a common hook-and-loop-type fastener, such as VELCRO®. The fastener halves 11*a*, 11*b* can be continuous strips, or a plurality of strips located at any portion along the respective tent cover 20 and mattress cover 12, in order to removably attach the mattress cover 12 to the tent cover 20 to cover the upper surface of the mattress 25.

An illuminating means is also removably or permanently attached to the inflatable frame, preferably at least a portion of the upright supports 16. In an embodiment, the illuminating means is a plurality of light-emitting diodes (LED) lamps 13 each in electrical communication, via cord 15, to a power source. The power source can be the same power source as the heating means 26, or another power source such as a battery pack. The battery pack can be supplied power via an external solar charging mechanism. Other embodiments may incorporate a switch, either located on the cord 15 or previously mentioned panel along with the port 40 and rheostat dial 41.

In a preferred embodiment, the mattress 25 is generally rectangular when fully inflated and the number of upright supports 16 is six (6), although different geometrical shapes of the mattress 25 and different numbers and orientations of the upright supports 16 fall under the overall scope of the invention. Other features commonly associated with tents 10, including, but not limited to: a rain fly, mosquito netting, anchoring tie-down and stakes, and the like, are intended to also fall under the overall scope of the invention.

Figure 3:
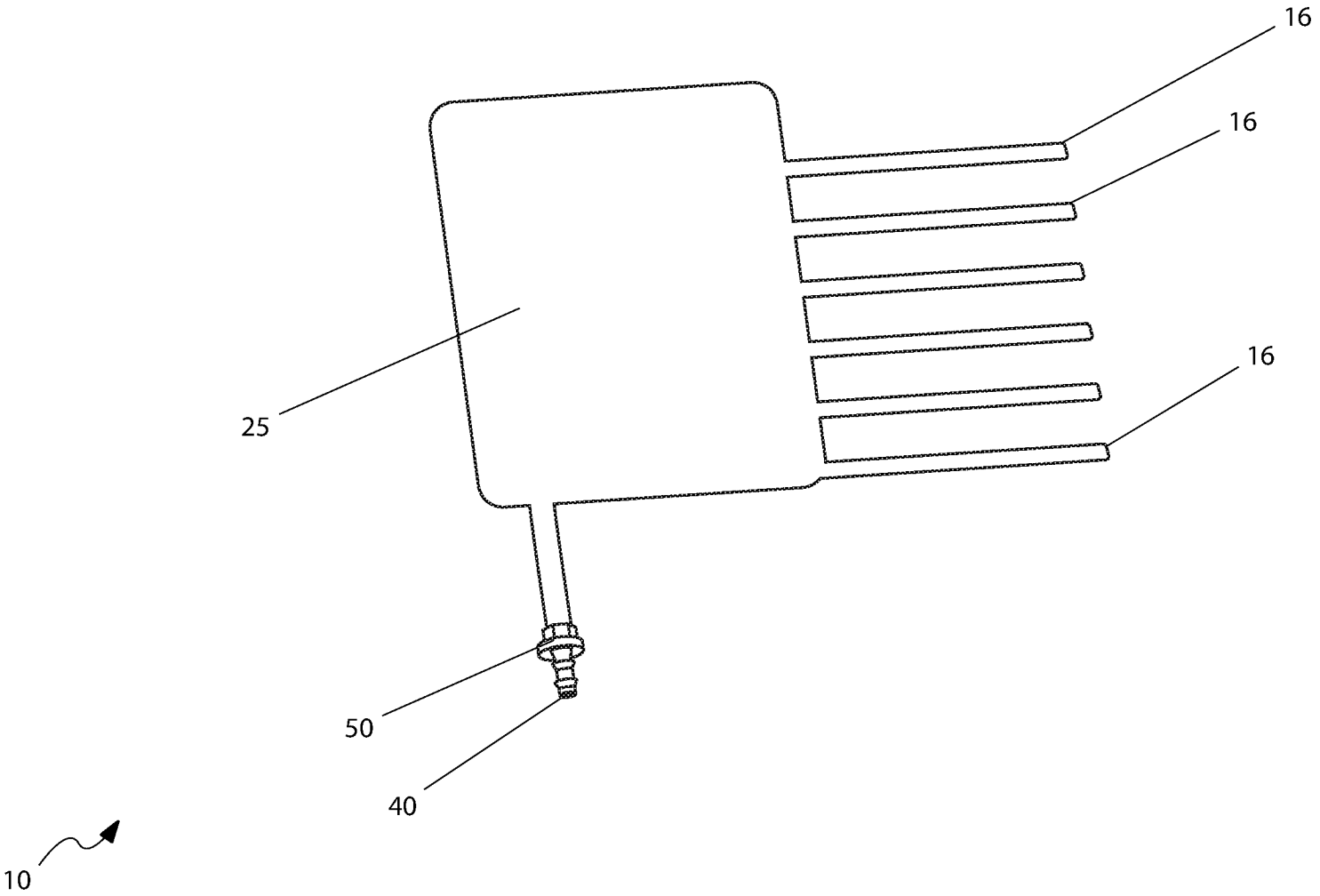
FIG. 3 is a flow diagram of the air pressurization components as used with the tent 10, according to the preferred embodiment of the present invention; and, FIG. 4 is an electrical block diagram of the major electrical components as used with the tent 10, according to the preferred embodiment of the present invention.

Referring next to FIG. 3, a flow diagram of the air pressurization components as used with the tent 10, according to the preferred embodiment of the present invention is shown. The mattress 25 is constructed with the upright supports 16 as a continuous bladder with all elements in direct fluid communication with each other. Inflation and deflation are provided through the port 40 along with a control valve 50. The control valve 50 allows for rapid deflation and may also allow the use of suction to remove all air from both the mattress 25 and the upright supports 16 for the minimum amount of storage space as possible.

Figure 4:
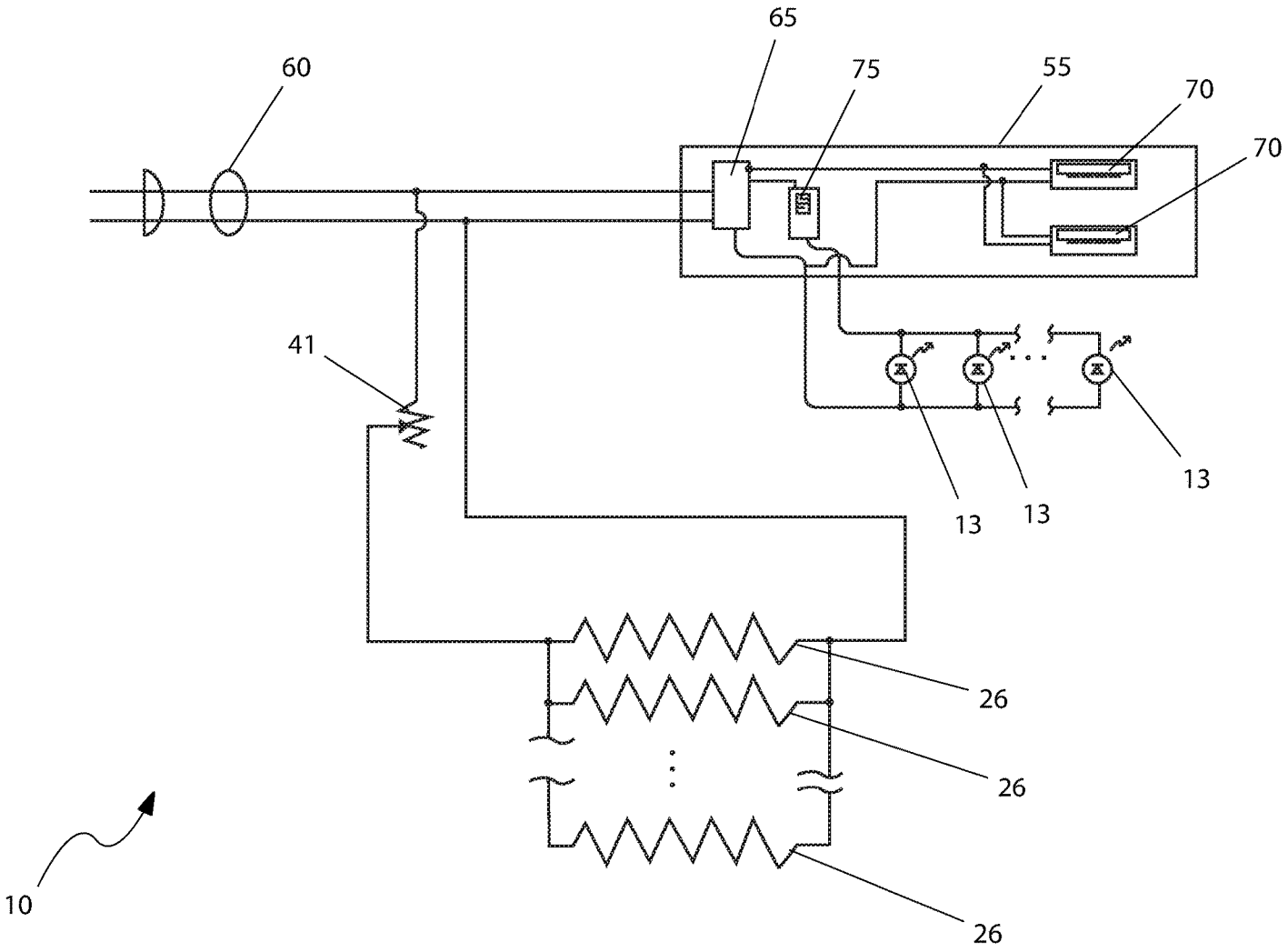

Referring to FIG. 4, an electrical block diagram of the major electrical components as used with the tent 10, according to the preferred embodiment of the present invention is depicted. Incoming alternating current (AC) power is provided via the power cord 60 and is routed to the rheostat dial 41 and the electronics control housing in a parallel manner. Output power from the rheostat dial 41 to one or more heating means 26. Multiple heating means 26, if used, are connected in a parallel circuit path as shown. Power to the electronics control housing 55 is routed into a power supply 65 with multiple outputs. One (1) set of outputs are connected to one (1) or more USB power ports 70, to provide power for operating or charging personal electronics such as cellular phones, tablet computers, radios, Wi-Fi hotspots, and the like. Another set of outputs from the power supply 65 are routed to a switch 75 that controls power to the multiple lamps 13 for illumination of the interior of the tent 10 during nighttime hours.

2. Operation of the Preferred Embodiment

The preferred embodiment of the present invention can be utilized by the common user in a simple and effortless manner with little or no training. It is envisioned that the tent 10 would be constructed in general accordance with FIG. 1 through FIG. 5. The user would procure the tent 10 from conventional procurement channels such as sporting goods stores, outdoor camping and hunting stores, discount stores, mail and internet sources or the like. Special attention would be paid to the overall size of the tent 10 and associated profiles.

After procurement and prior to utilization, the tent 10 would be prepared in the following manner: a suitable setup location would be chosen; a compressed air source such as an air compressor, foot pump, air tank, or the like would be connected to the port 40; with the control valve 50 open, the mattress 25 and the upright supports 16 are inflated; the control valve 50 is closed and compressed air source may be removed; the power cord 60 is then connected to a suitable source of AC power. At this point in time, the tent 10 is ready for use.

During utilization of the tent 10, the following procedure would be initiated: the tent is occupied in a standard manner for sleeping or other relaxation purposes; should USB power (5.0 VDC, 2.0 amperes) be needed, users may connect to the USB power ports 70 within the electronics control housing 55; should users require supplemental lighting, the lamps 13 may be activated by the switch 75 also within the electronics control housing 55; should heating be desired, the heating means 26 may be energized in a controlled manner by the rheostat dial 41.

After use of the tent 10, the power cord 60 would be disconnected; the mattress 25 and the upright supports 16 would be deflated by opening the control valve 50 and allowing the contained air to exhaust; should faster and more complete deflation be desired, a vacuum source can be connected to the port 40 to speed the process. The tent 10 would then be folded for storage until needed again in a repeating cyclical process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tent, comprising:

an inflatable frame covered by a tent cover, the tent cover includes a door flap removably affixed to the tent cover, the tent cover having a plurality of sides;

a window provided on the tent cover;

a control access flap positioned on one side of the tent cover, the control access flap providing access to a plurality of mattress controls and a means for heating;

the inflatable frame comprises:

a mattress having a plurality of upright supports in fluid communication with the mattress, the upright supports are intended to provide equal distribution of support for the tent cover, the mattress is an inflatable bladder, the means for heating is located within the mattress, the upright supports having a first end and a second end;

a port disposed along one side of the mattress in mechanical and fluid communication with a means for delivering an inflatable medium within the mattress and subsequently the upright supports, the port includes a cover to prevent the inflatable medium from exiting the mattress;

a rheostat dial being in selective electrical communication between an outside power source and the means for heating, the rheostat dial selectively powers the means for heating as well as control a desired temperature;

an electronics control housing located on an interior of the tent;

a power cord to allow for user control of a plurality of electrical components as used with the tent;

a mattress cover shaped to fully cover the mattress when fully inflated as well as covering a plurality of attachment points where the first ends of the upright supports engage with the mattress;

a first fastener half located on an interior surface of the tent cover at a location superjacent to the upper surface of the mattress when fully inflated;

a second fastener half located on a perimeter edge of one side of the mattress cover;

a means for illuminating attached to the inflatable frame;

a control valve allowing for rapid deflation and allow suction to remove said inflatable medium from the mattress and the upright supports for a minimum amount of storage space; and one or more USB power ports providing power for operating or charging personal electronics.

2. The tent according to claim 1, wherein the door flap is removably affixed to the tent cover by a zipper.

3. The tent according to claim 2, wherein the zipper is continuous to enable a portion of the door flap to remain attached to a remainder of the tent cover.

4. The tent according to claim 1, wherein the tent cover is removably attachable to the inflatable frame.

5. The tent according to claim 1, wherein the tent cover is permanently affixed to the inflatable frame.

6. The tent according to claim 1, wherein the tent cover has a generally rectangular shape made of waterproof fabric.

7. The tent according to claim 1, wherein the window is removable.

8. The tent according to claim 1, wherein the window is transparent.

9. The tent according to claim 1, wherein the outer bottom perimeter of the tent cover includes a base made of material selected from the group consisting of waterproof material, resilient material, and puncture-resistant material.

10. The tent according to claim 1, wherein the mattress is generally rectangular shaped when fully inflated and forms a bottom base of the tent.

11. The tent according to claim 1, wherein each of the upright supports have the first end attached to and extending away from an upper perimeter location on the mattress.

12. The tent according to claim 1, wherein the second ends of the upright supports terminate in a common point, thereby ensuring that each of the upright support of the mattress is in fluid communication with each other to provide proper and even distribution of the inflatable medium.

13. The tent according to claim 1, wherein the means for heating is a continuous single electrically-resistive heating coil.

14. The tent according to claim 13, wherein the means for heating is a plurality of the continuous single electrically-resistive heating coils arranged in a plurality of zones.

15. The tent according to claim 1, wherein the means for delivering an inflating medium is a compressor.

16. The tent according to claim 1, wherein the port includes a cap to prevent the inflatable medium from exiting the mattress.

17. The tent according to claim 1, wherein the rheostat dial is located adjacent the port, both of which being located on a panel and provided on the same side as the control access flap, such that access to the port and the rheostat dial is provided externally from the tent.

18. The tent according to claim 1, wherein the electronics control housing is located along an edge of the mattress such that it does not interfere with usage of the mattress but remains easy to access by hand while occupying the tent.

19. The tent according to claim 1, wherein the first fastener half and the second fastener half are corresponding halves of a hook-and-loop-type fastener.

20. The tent according to claim 1, wherein the means for illuminating is a plurality of light-emitting diodes lamps.

* * * * *